US006570818B1

(12) United States Patent
Kirjavainen

(10) Patent No.: US 6,570,818 B1
(45) Date of Patent: May 27, 2003

(54) ELECTROACOUSTIC TRANSDUCER

(75) Inventor: Kari Kirjavainen, Espoo (FI)

(73) Assignee: Panphonics Oy, Espoo (FI)

( * ) Notice: Subject to any disclaimer, the term of this patent is extended or adjusted under 35 U.S.C. 154(b) by 0 days.

(21) Appl. No.: 09/202,002

(22) PCT Filed: Jun. 6, 1997

(86) PCT No.: PCT/FI97/00354

§ 371 (c)(1),
(2), (4) Date: May 3, 1999

(87) PCT Pub. No.: WO97/48253

PCT Pub. Date: Dec. 18, 1997

(30) Foreign Application Priority Data

Jun. 7, 1996 (FI) ..... 962386

(51) Int. Cl.[7] ..... H04R 19/02; H04R 3/00
(52) U.S. Cl. ..... 367/137; 367/903
(58) Field of Search ..... 367/903, 181, 367/137

(56) References Cited

U.S. PATENT DOCUMENTS

| | | | | |
|---|---|---|---|---|
| 3,916,373 A | | 10/1975 | Schroder | 367/137 |
| 4,207,442 A | | 6/1980 | Freeman | 381/116 |
| 4,286,122 A | | 8/1981 | Iding | 381/163 |
| 4,404,502 A | | 9/1983 | Magori et al. | 381/116 |
| 4,817,066 A | * | 3/1989 | Takasugi et al. | 367/903 |
| 5,161,128 A | | 11/1992 | Kenney | 367/181 |

FOREIGN PATENT DOCUMENTS

| | | | | |
|---|---|---|---|---|
| DE | 2324211 | | 11/1973 | |
| FI | 74183 | | 8/1987 | |
| GB | 1499575 | | 2/1978 | |
| GB | 2296365 | | 6/1996 | |
| JP | 62155698 | | 7/1987 | |
| JP | 6321583 | * | 1/1988 | G01S/15/06 |

OTHER PUBLICATIONS

International search report dated Feb. 10, 1997.
Office action issued in Finnish priority application 962386.

* cited by examiner

*Primary Examiner*—Daniel Pihulic
(74) *Attorney, Agent, or Firm*—Marshall, Gerstein & Borun

(57) ABSTRACT

The present invention relates to an electroacoustic transducer where the voltage of a capacitive acoustic element is controlled by charging and discharging the charge of the element via an inductance (L) by fast switches ($K_1$, $K_2$). In the case energy unconverted into the acoustic energy of the transducer can be transferred to an energy storage of an electrical circuit formed by the inductance (L) and the capacitance ($C_1$, $C_2$, $C_0$) during each control sequence and in this way the transducer can be made to operate with a good coefficient of efficiency.

14 Claims, 6 Drawing Sheets

ELECTROACOUSTIC TRANSDUCER

Figure 1A:
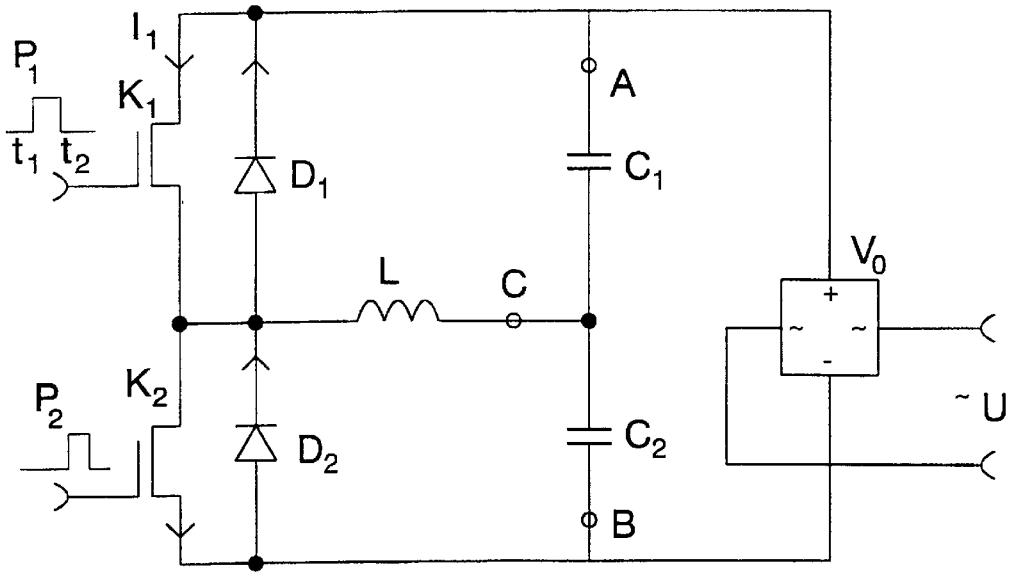

The invention relates to an electroacoustic transducer comprising a capacitive acoustic element and at least two switches for controlling the voltage acting on the element, in which case the switches are arranged to control the voltage acting on the element by controlling the on and off times of the switches.

The coefficient of efficiency of sound reproducers based on magnetic loudspeakers is typically very low, about 0.5%, for example. It is known to control magnetic loudspeakers by so-called chopper amplifiers in which case the efficiency of the amplifier is reasonably good, but as the resistance of the coil of the loudspeaker is fairly great, it causes a great power loss and the total efficiency of the sound reproducer will thus be very low.

DE-2324211 discloses a capacitive acoustic element but the reference cited does not disclose the control arrangements of the element. U.S. Pat. Nos. 4,207,442, 4,286,122 and 5,161,128 also disclose a capacitive acoustic element and various control switchings and arrangements of the element. All the solutions mentioned above have it in common that the coefficient of efficiency will not be very good by means of them.

The object of the present invention is to provide an electroacoustic transducer whose coefficient of efficiency will be very good.

The transducer of the invention is characterized in that an inductance is connected to at least one electrode of the acoustic element, through which inductance voltage is arranged to act on the acoustic element, and that the transducer comprises a capacitance that together with the inductance forms an electrical circuit in such a manner that the capacitance and the inductance together operate as an energy storage for storing energy unconverted into acoustic power.

The essential idea of the invention is that the capacitive acoustic element is controlled by means of at least two fast switches, in which case by controlling the off and on times of the switch, the voltage acting on the transducer is controlled. A further essential idea is that an inductance is connected to at least one electrode of the acoustic element, through which inductance voltage is arranged to act on the acoustic element. The inductance together with the capacitance of the transducer forms an oscillating circuit in such a manner that the inductance and capacitance in question are able to store energy unconverted into acoustic energy and supply it back to the transducer. The energy stored into the acoustic element is transferred almost without loss e.g. to another block of the element or to an independent storage capacitor and back to the element. The idea of one preferred embodiment is that the switches are controlled by pulses whose width is determined by means of the difference of an audio signal and the voltage of the transducer, that is, pulse width modulation is used. Furthermore, the idea of a second preferred embodiment is that the acoustic element is formed of a serial connection of two capacitors, at least one of which is acoustically active.

The advantage of the invention is that the coefficient of efficiency of the equipment is very good as only that amount of energy will be consumed that the transducer emits out as acoustic power and the portion used for the switch losses of control electronics.

A separate auxiliary capacitor will not be needed for the electrical circuit when the acoustic element comprises two capacitors.

Figure 1B:
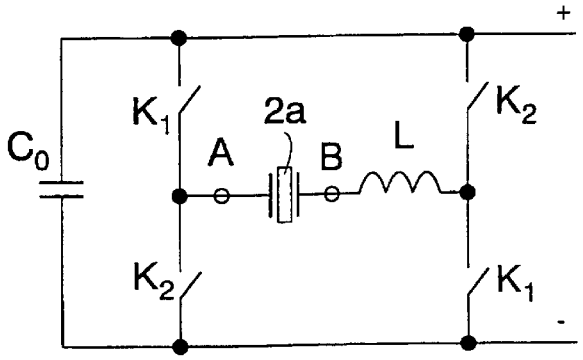
Figure 1C:
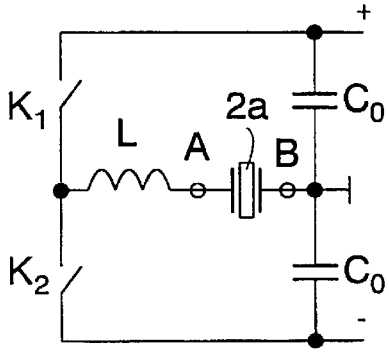
Figure 2:
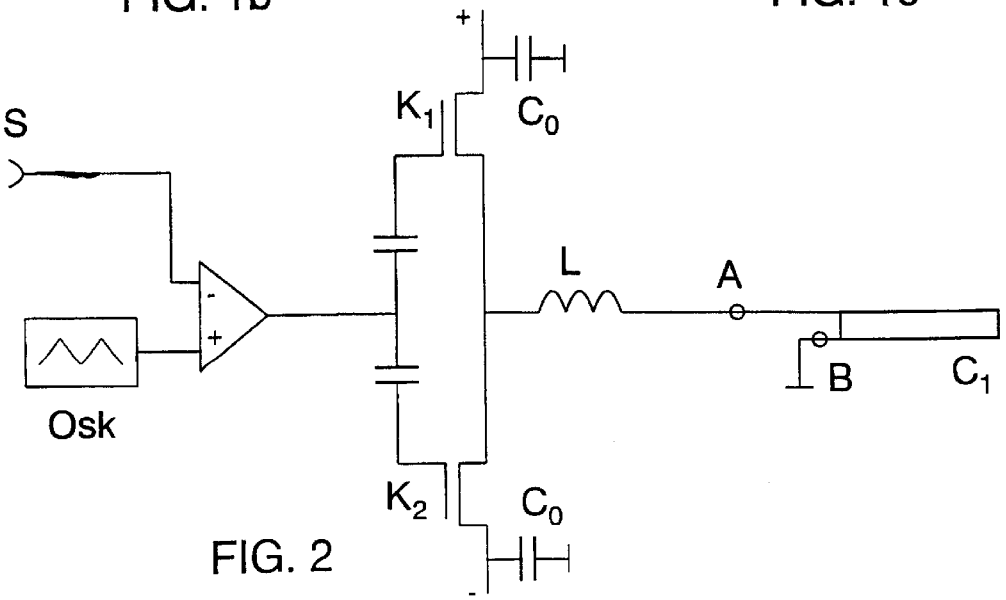
Figure 3:
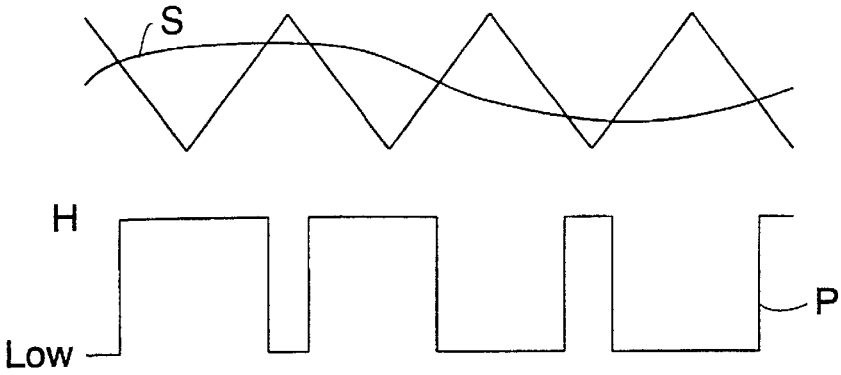
Figure 4A:
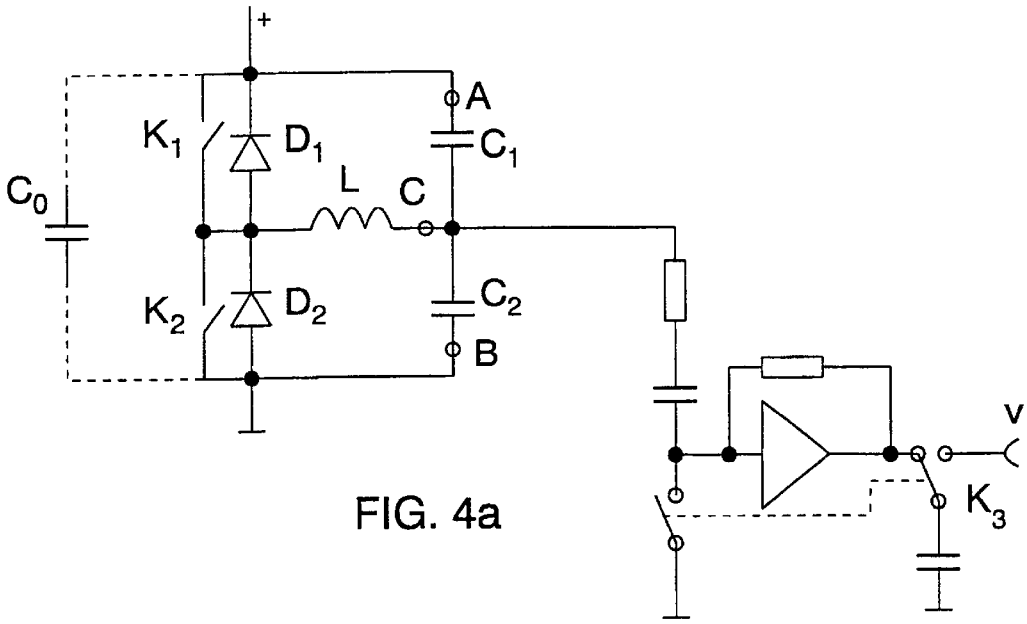
Figure 4B:
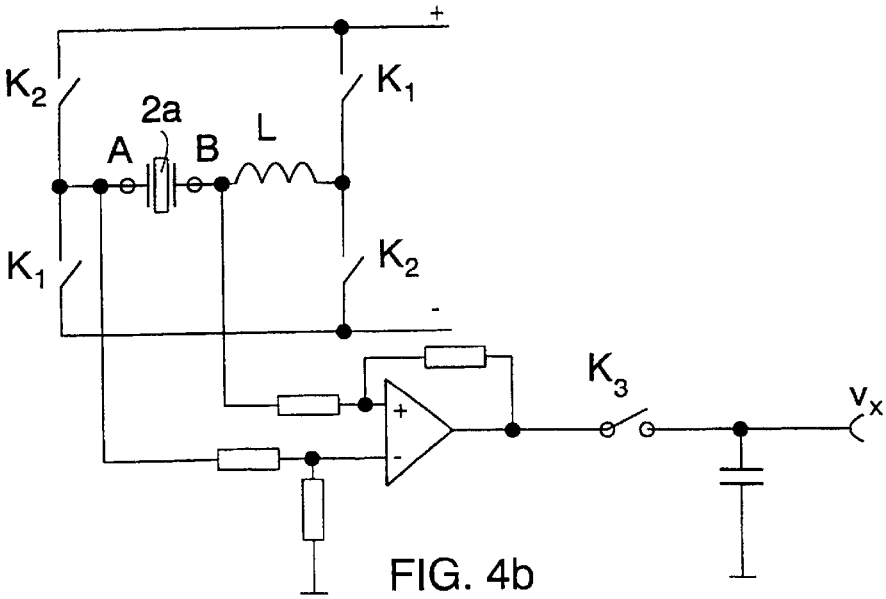
Figure 5A:
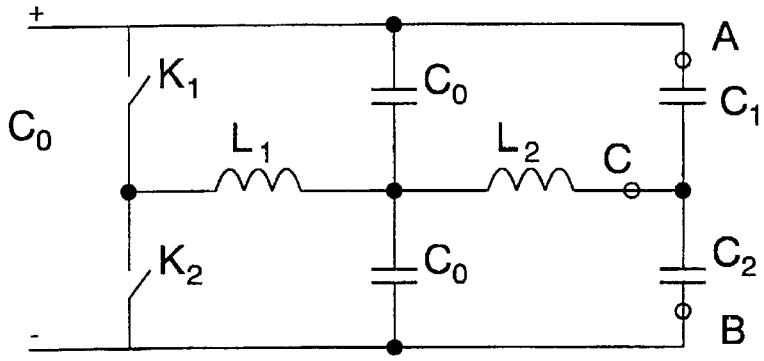
Figure 5B:
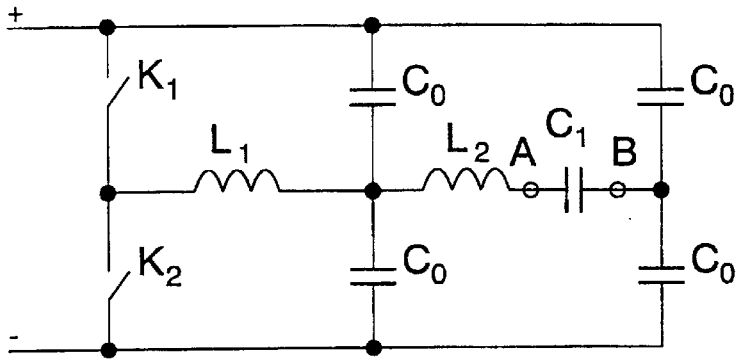
Figure 6:
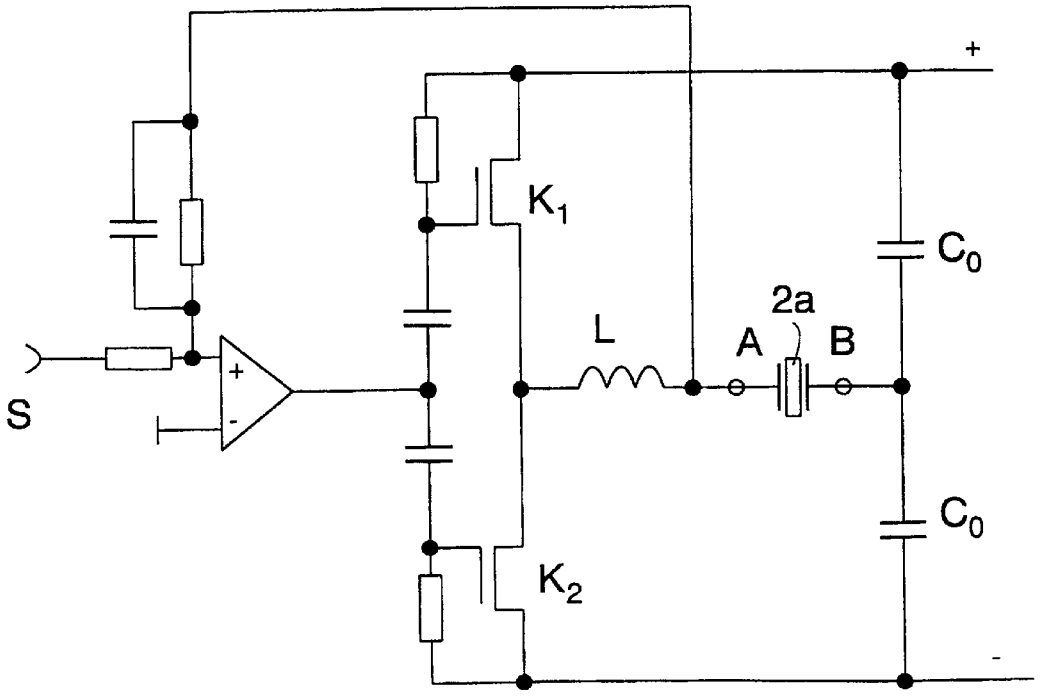
Figure 7A:
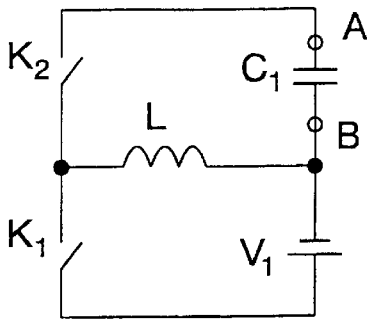
Figure 7B:
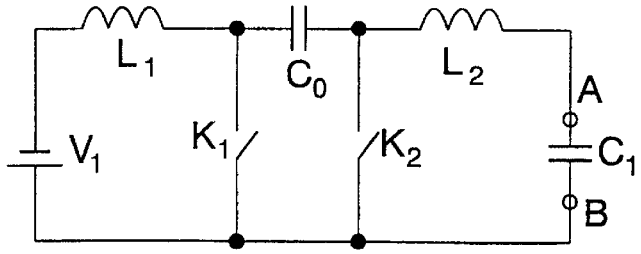
Figure 7C:
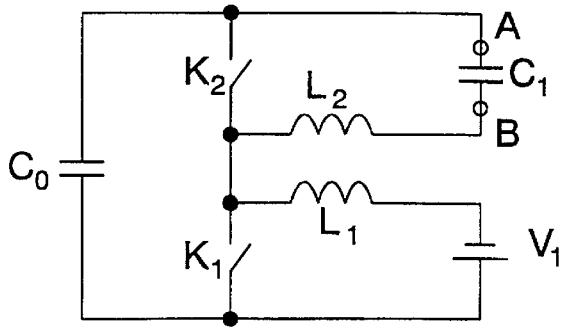
Figure 8:
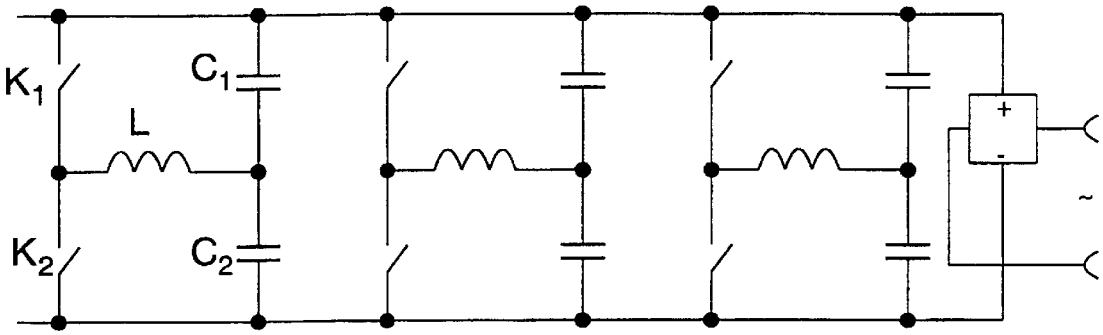
Figure 9A:
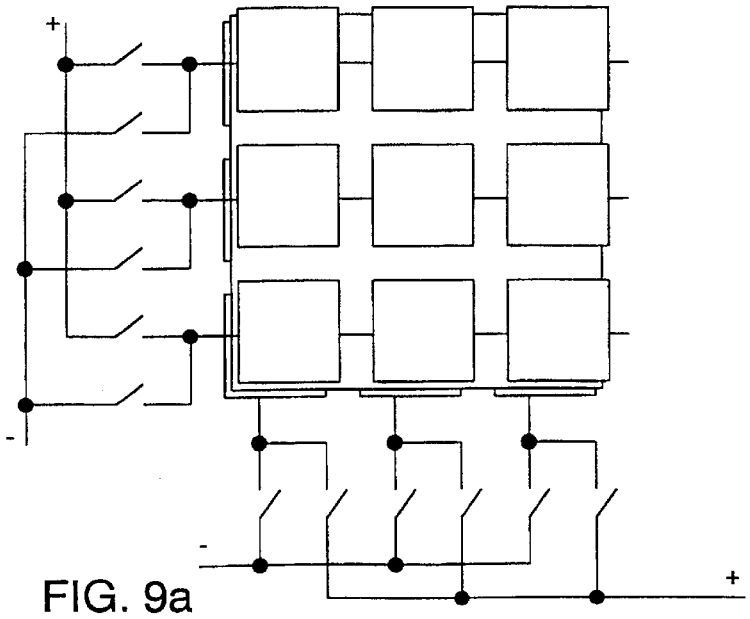
Figure 9B:
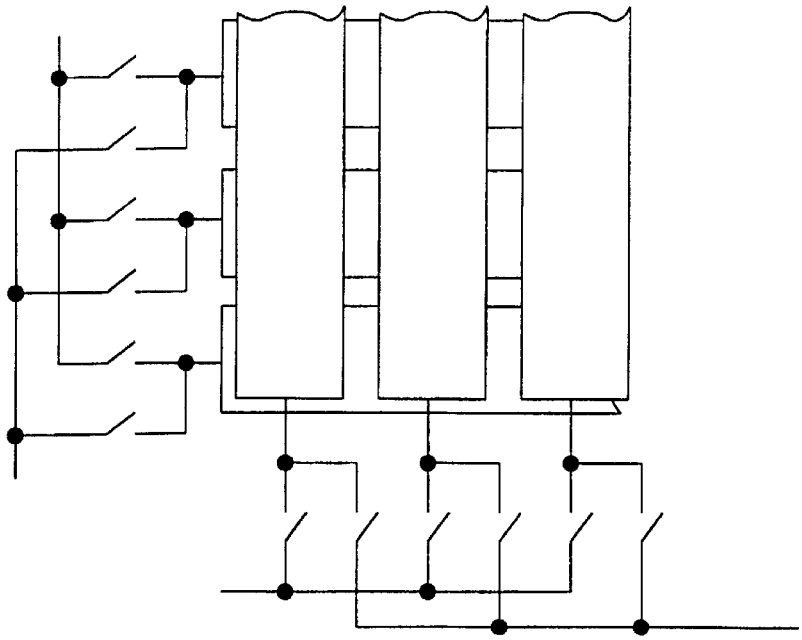
Figure 10:
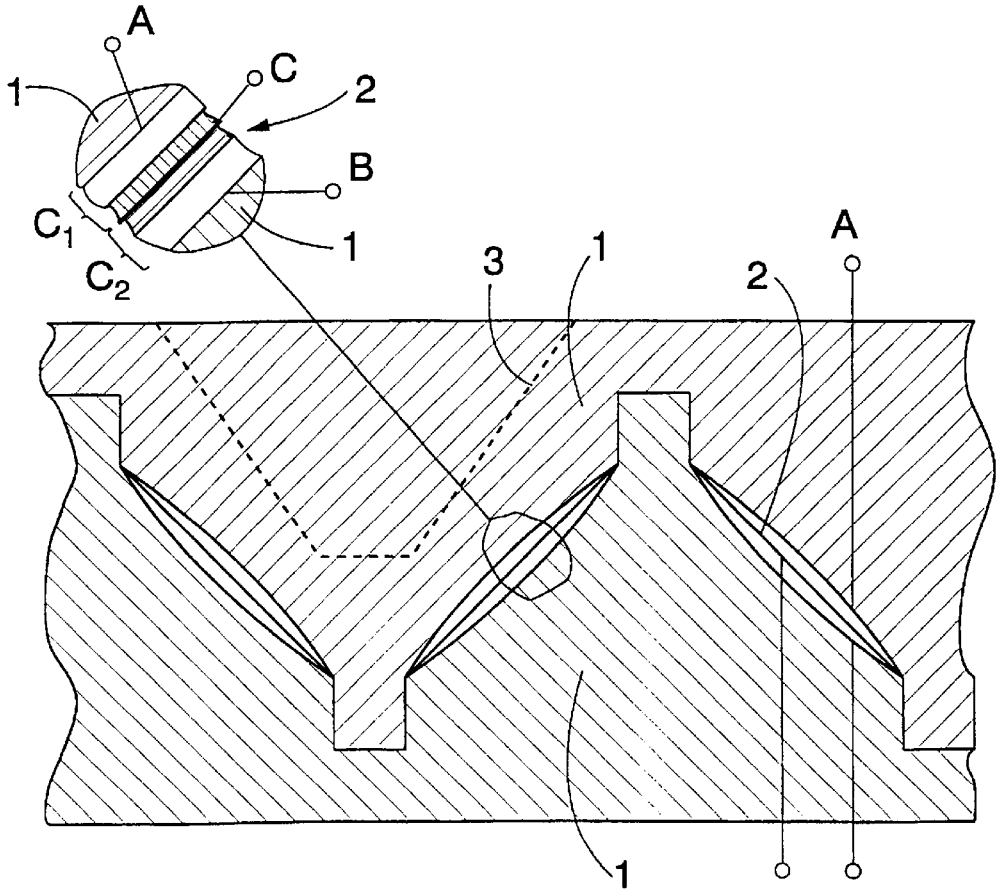
Figure 11:
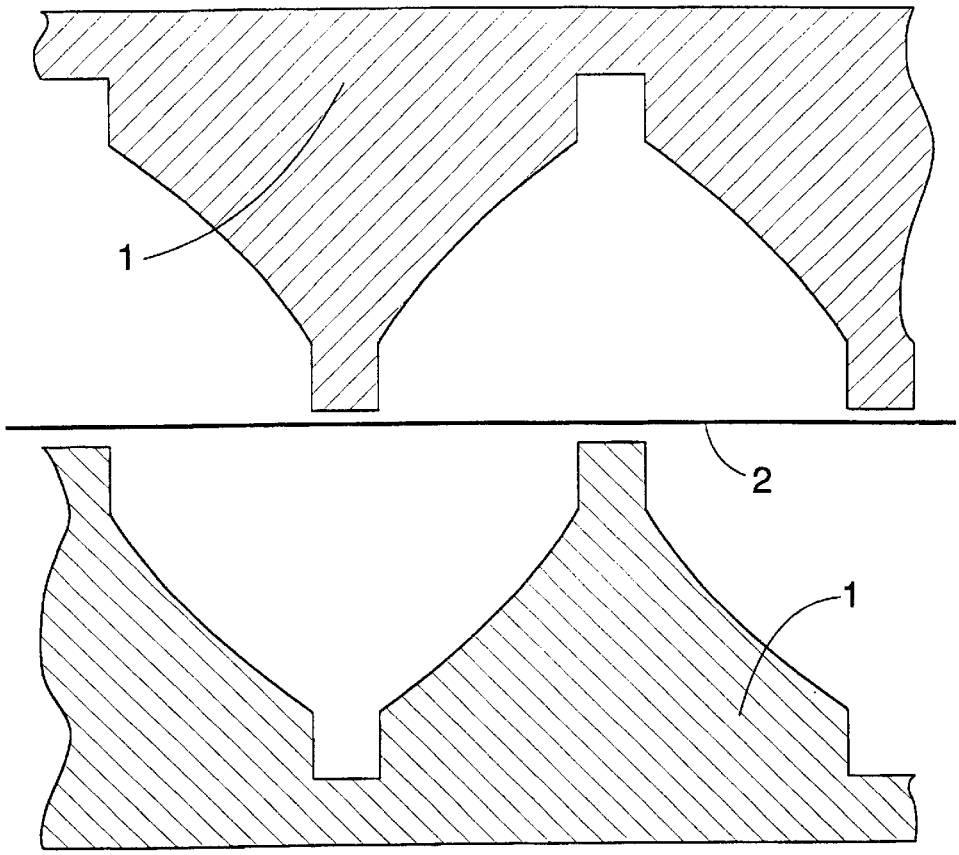
Figure 12A:
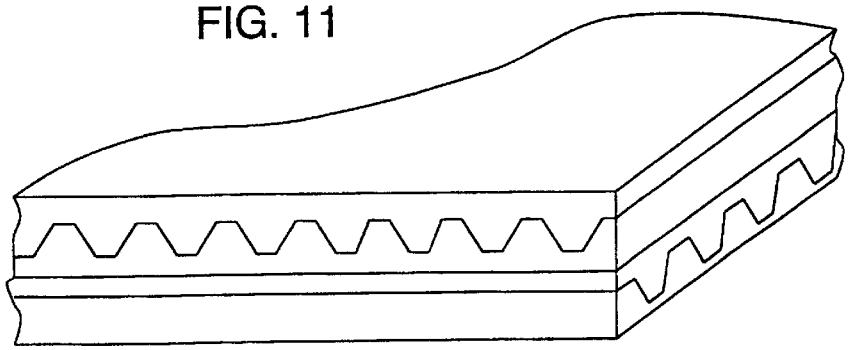
Figure 12B:
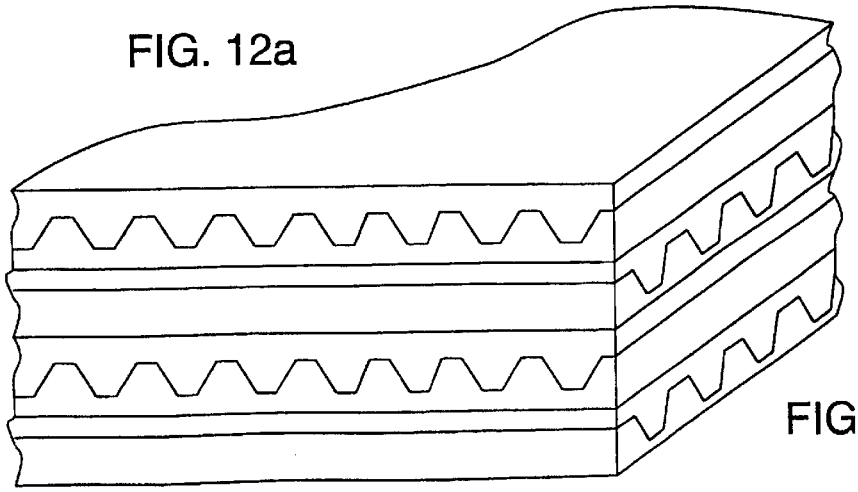

The invention will be explained in more detail in the appended drawings, wherein FIGS. 1*a* to 1*c* illustrate diagrams of three different embodiments of the electroacoustic transducer of the invention, FIG. 2 shows a diagram of a fourth embodiment of the electroacoustic transducer of the invention, FIG. 3 shows a schematic diagram for forming control pulses of switches, FIGS. 4*a* and 4*b* show alternatives for coupling the transducers of the invention as sensors, FIGS. 5*a* and 5*b* show diagrams of a fifth and a sixth embodiment of the electroacoustic transducer of the invention, FIG. 6 shows a diagram of a seventh embodiment of the electroacoustic transducer of the invention, FIGS. 7*a* to 7*c* show further diagrams of some embodiments of the invention, FIG. 8 shows a diagram of a parallel connection of the transducers of the invention, FIGS. 9*a* and 9*b* are schematic views of matrix-constructed transducer systems, FIG. 10 is a schematic, cross-sectional side view of a part of one capacitive acoustic element, FIG. 11 shows a construction stage of the element of FIG. 10, and FIGS. 12*a* and 12*b* shows the elements of FIG. 10 placed on top of one another.

FIG. 1*a* shows the principle of the system. The system comprises capacitive acoustic elements $C_1$, $C_2$, switches $K_1$, $K_2$, diodes $D_1$, $D_2$, an inductance L and a power supply $V_0$. By switching on and off the switches $K_1$, $K_2$ on a frequency of 1 MHz, for example, by regulating the switching times of pulses $P_1$ and $P_2$, the voltage integrated into point C can be controlled, the voltage being a sound-producing voltage in the transducer. Points A and B illustrate electrodes A and B to be connected to essentially stationary surfaces of the element of FIG. 10, for example, and point C illustrates an electrode C to be connected to a moving diaphragm 2. Mains voltage U is rectified, in which case the operating voltage of the transducer is 320 V, for example. This voltage is stored into capacitors $C_1$ and $C_2$, at least one of which emits sound, that is, it is an acoustically active capacitive element. The energy $E_C$ stored into the capacitor is $0.5*CU^2$, that is, for example, if $C_1=C_2=1\ \mu F$, it is derived that $E_{C1}$ is about 0.05 joules. The voltage acting on point C is controlled by the switches $K_1$ and $K_2$. By switching on the switch $K_1$ at moment $t_1$, the energy of the capacitor $C_1$ will start flowing to the inductance L, which flow is described by current $I_1$. The energy of the inductance L depends on the attained current which is dependent on the on time $t_2$ of the switch $K_1$. The energy $E_L$ stored into the inductance is $0.5*LI^2$, that is, for example, if L is 100 $\mu$H and I is one ampere, $E_L=50$ $\mu$joules. Thus the energy of the capacitor is reduced by 50 $\mu$joules. The reduction of the capacitor voltage is derived from formula $U=\sqrt{2*\Delta E:C}$, that is, the capacitor voltage is reduced by 10 V. The energy stored into the inductance can now be transferred to the capacitor $C_2$ by switching on the switch $K_2$. If the switching time is the same as above, in principle 50 $\mu$joules is transferred to the capacitor $C_2$, that is, its voltage rises by 10 V. In this way the voltage of point C in the transducer can be controlled without any great energy losses. Losses are produced in the resistances of the circuit. For example, the resistance of switching transistors can typically be about 0.2Ω. Then the power loss PL is about 0.2 W. The acoustic coefficient of efficiency $\alpha$ of the transducer is typically about 1%, in which case $\alpha*\Delta E=0.5\ \mu J$ will be transferred into acoustic energy. When the length of the control pulse has been 1 $\mu$s, 0.5 W of power has been transferred via the acoustic transducer. When the losses were 0.2 W, the efficiency of the system is 60%. The system needs to supply only the required additional energy from the power supply because the oscillating circuit formed by the inductance and capacitance acts as an energy storage.

FIGS. 1*b* and 1*c* show alternative switching arrangements of the transducer of the invention. In these cases the acoustic element comprises a permanently charged electret diaphragm 2*a*, whereby the element does not have a separate electrode C. Auxiliary capacitors $C_0$ act as an energy storage.

FIG. 2 shows a solution where an audio signal S is compared in a comparator with a triangular wave produced by the oscillator, whereby pulses required for controlling the switches will be provided. The required pulses can also be formed digitally, in which case the system converts digital sound information directly into sound without digital-to-analog converters. For the sake of clarity, in the present application all the components in the figures have not been named and explained as their meaning and operation is evident to those skilled in the art.

FIG. 3 shows schematically the principle of pulse width modulation, that is, by comparing the signal S with a triangular wave, the widths of the control pulse P are determined in a manner known per se. For example, in the case of FIG. 2, when the value of the control pulse P is high H, the switch $K_1$ is controlled to be on and when the value is Low, the switch $K_2$ is controlled to be on.

Because the transducer can be separated by switches $K_1$ and $K_2$ from a controlling signal, the transducer acts then as a sensor. In FIG. 4*a*, by switching on the switch $K_3$, it is possible to measure as a sample the moving speed V of the diaphragm of the transducer. FIG. 4*b* shows a bridge-connected transducer where when the switches $K_1$ and $K_2$ are off, the moving deviation $V_x$ of the diaphragm of the transducer can be measured by switching on the switch 3. The measured signals can be used as feedback signals in the control of the transducer and sensors for other purposes.

FIG. 5*a* shows an application where the effect of switching pulses is filtered with an additional filter which is formed by the capacitor $C_0$ and inductance $L_1$. Inductance $L_2$ is connected to point C. FIG. 5*b* shows an application where the acoustic element is formed only of one capacitor $C_1$ to which a DC component is not directed.

FIG. 6 shows an amplification can be used, in which case distortion can be rendered very small. An input signal S is compared with the voltage of the transducer in a comparator which provides the control pulses for the switches $K_1$ and $K_2$.

FIGS. 7*a* to 7*c* show solutions where a low voltage accumulator of 12 V, for example, is used as a power supply $V_1$. By switching on the switch $K_1$, energy is transferred from the accumulator to the inductance L and the amount of energy is dependent on the time the $K_1$ is switched on. By switching on the switch $K_2$, the energy of the inductance L can be transferred to the element $C_1$. By repeating the sequences mentioned above several times by a fast frequency of 1 MHz, for example, the desired voltage can be transferred to the element. The voltage of the element can be correspondingly discharged to the power supply by switching on the switch $K_2$ first, in which case the energy of the transducer is transferred to the inductance L and can be transferred therefrom to the power supply by switching on the switch $K_1$.

FIG. 8 shows a principle of how the transducers of the invention can be connected in parallel. FIGS. 9*a* and 9*b* show transducers connected as matrixes, in which case the number of switches can be reduced and the characteristics of the acoustic field produced by controlling the switches in different ways can be adjusted.

FIG. 10 shows an acoustic element whose frame sections 1 are produced of a porous material and whose inner surface is electrically conductive. The inner surfaces form electrodes A and B. A moving diaphragm 2 is arranged between the frame sections. FIG. 10 shows that the moving diaphragm 2 is an electret diaphragm which has an electrically conductive layer in the middle. The moving diaphragm can also be made of non-electrically conductive diaphragms, to the middle of which an electrically conductive diaphragm is arranged, or the diaphragm 2 can also be formed of a permanently charged electret diaphragm 2. Recesses 3 shown with broken lines can also be made to the frame section 1 of the element to lighten the plate. The electrode C of the diaphragm 2 can be divided into blocks and the electrodes A and B can also be divided as desired and the element can be controlled as a matrix, as described above.

FIG. 11 is a schematic view of a construction method of the element. The frame sections 1 are sintered in a mould from plastic powder and at least their inner surfaces are coated with metal. The diaphragm 2 is stretched at its edges as shown in FIG. 11. After this, the frame sections 1 are pressed against one another, whereby the diaphragm 2 will be stretched tight and oriented to be thinner. In this way the distances between different electrodes can be minimized and the coefficient of efficiency can be maximized.

FIGS. 12*a* and 12*b* show solutions where different elements are connected on top of one another so that both dipole and monopole sound sources and sensors can be produced of them.

The drawings and the specification relating thereto are only intended to illustrate the idea of the invention. In its details, the invention may vary in the scope of the claims. Therefore any capacitive acoustic element may be used in connection with the invention, that is, it may be an electrostatic, a piezoelectric or an electret transducer, for example.

What is claimed is:

1. An electroacoustic transducer comprising a capacitive acoustic element, at least two switches for controlling a voltage acting on the element, wherein the switches are arranged to control the voltage acting on the element by controlling the on and off times of the switches, and an inductance coupled to at least one electrode of the acoustic element, through which inductance voltage is arranged to act on the acoustic element, wherein the inductance is configured such that the voltage acting on the element is an integrated signal.

2. A transducer of claim 1, wherein the acoustic element is coupled by means of the inductance to a connecting point of the switches coupled in series.

3. A transducer of claim 1, wherein the switches are controlled by the pulses formed based on the difference of an audio signal and a reference signal supplied to the transducer.

4. A transducer of claim 1, wherein the acoustic element is formed of a serial connection of two capacitors, at least one of which is acoustically active.

5. A transducer of claim 1, wherein the acoustic element comprises at least two porous frame sections pleated at their inner surfaces and coated with metal at least at their inner surfaces, between which frame sections a moving diaphragm is stretched.

6. A transducer of claim 1, wherein the acoustic element is divided into several blocks which are controlled as matrixes.

7. A transducer of claim 1, wherein the transducer comprises several acoustic elements which are interconnected and arranged to be controlled as matrixes.

8. A transducer of claim 1, wherein the transducer additionally comprises a capacitance that together with the inductance forms an electrical circuit in such a manner that the capacitance and the inductance together operate as an energy storage for storing energy unconverted into acoustic power.

9. An electroacoustic transducer comprising a capacitive acoustic element, at least two switches for controlling a voltage acting on the element, wherein the switches are arranged to control the voltage acting on the element by controlling the on and off times of the switches, and an inductance means, coupled to at least one electrode of the acoustic element, for supplying an integrated signal to the at least one electrode.

10. An electroacoustic transducer comprising a capacitive acoustic element and at least two switches for controlling a voltage acting on the element, wherein the switches are arranged to control the voltage acting on the element by controlling the on and off times of the switches wherein an inductance is connected to at least one electrode of the acoustic element, through which inductance voltage is arranged to act on the acoustic element, and that the transducer comprises a capacitance that together with the inductance forms an electrical circuit in such a manner that the capacitance and the inductance together operate as an energy storage for storing energy unconverted into acoustic power; wherein the switches are controlled by the pulses formed by the difference of an audio signal and the voltage supplied to the transducer.

11. An electroacoustic transducer comprising a capacitive acoustic element and at least two switches for controlling a voltage acting on the element, wherein the switches are arranged to control the voltage acting on the element by controlling the on and off times of the switches wherein an inductance is connected to at least one electrode of the acoustic element, through which inductance voltage is arranged to act on the acoustic element, and that the transducer comprises a capacitance that together with the inductance forms an electrical circuit in such a manner that the capacitance and the inductance together operate as an energy storage for storing energy unconverted into acoustic power; wherein the acoustic element is formed of a serial connection of two capacitors, at least one of which is acoustically active.

12. An electroacoustic transducer comprising a capacitive acoustic element and at least two switches for controlling a voltage acting on the element, wherein the switches are arranged to control the voltage acting on the element by controlling the on and off times of the switches wherein an inductance is connected to at least one electrode of the acoustic element, through which inductance voltage is arranged to act on the acoustic element, and that the transducer comprises a capacitance that together with the inductance forms an electrical circuit in such a manner that the capacitance and the inductance together operate as an energy storage for storing energy unconverted into acoustic power; wherein the acoustic element comprises at least two porous frame sections pleated at their inner surfaces and coated with metal at least at their inner surfaces, between which frame sections a moving diaphragm is stretched.

13. An electroacoustic transducer comprising a capacitive acoustic element and at least two switches for controlling a voltage acting on the element, wherein the switches are arranged to control the voltage acting on the element by controlling the on and off times of the switches wherein an inductance is connected to at least one electrode of the acoustic element, through which inductance voltage is arranged to act on the acoustic element, and that the transducer comprises a capacitance that together with the inductance forms an electrical circuit in such a manner that the capacitance and the inductance together operate as an energy storage for storing energy unconverted into acoustic power; wherein the acoustic element is divided into several blocks which are controlled as matrixes.

14. An electroacoustic transducer comprising a capacitive acoustic element and at least two switches for controlling a voltage acting on the element, wherein the switches are arranged to control the voltage acting on the element by controlling the on and off times of the switches wherein an inductance is connected to at least one electrode of the acoustic element, through which inductance voltage is arranged to act on the acoustic element, and that the transducer comprises a capacitance that together with the inductance forms an electrical circuit in such a manner that the capacitance and the inductance together operate as an energy storage for storing energy unconverted into acoustic power; wherein the transducer comprises several acoustic elements which are interconnected and arranged to be controlled as matrixes.

* * * * *